US010225667B2

(12) United States Patent
Puder

(10) Patent No.: US 10,225,667 B2
(45) Date of Patent: Mar. 5, 2019

(54) METHOD AND HEARING AID FOR FREQUENCY-DEPENDENT REDUCTION OF NOISE IN AN INPUT SIGNAL

(71) Applicant: SIVANTOS PTE. LTD., Singapore (SG)

(72) Inventor: Henning Puder, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 172 days.

(21) Appl. No.: 15/064,787

(22) Filed: Mar. 9, 2016

(65) Prior Publication Data

US 2016/0269835 A1 Sep. 15, 2016

(30) Foreign Application Priority Data

Mar. 10, 2015 (DE) ..... 10 2015 204 253

(51) Int. Cl.
*H04R 25/00* (2006.01)
*H04R 1/10* (2006.01)
(Continued)

(52) U.S. Cl.
CPC ..... *H04R 25/505* (2013.01); *H04R 1/1083* (2013.01); *H04R 25/353* (2013.01);
(Continued)

(58) Field of Classification Search
None
See application file for complete search history.

(56) References Cited

U.S. PATENT DOCUMENTS 4,099,035 A 7/1978 Yanick
4,630,304 A 12/1986 Borth et al.
(Continued)

FOREIGN PATENT DOCUMENTS

CN 101645267 A 2/2010
CN 102469387 A 5/2012
(Continued)

OTHER PUBLICATIONS

Traore David et al.: "Compensation of Crossover Region Overshoot in Multiband Compression", JAES, AES, New York, USA, Apr. 25, 2014 (Apr. 25, 2014), XP-040637022.
(Continued)

*Primary Examiner* — Duc Nguyen
*Assistant Examiner* — Taunya McCarty
(74) *Attorney, Agent, or Firm* — Laurence A. Greenberg; Werner H. Stemer; Ralph E. Locher

(57) ABSTRACT

A method performs frequency-dependent reduction of noise in an input signal, wherein the input signal is allocated to a main signal path and to an auxiliary signal path. A filter bank separates the input signal into a plurality of frequency bands each having a certain bandwidth and center frequency. In the auxiliary signal path, the bandwidth of the signal component is reduced in each frequency band thus forming a reduced frequency band in each case. Wherein in each reduced frequency band, a reduction parameter is determined from the signal component of the input signal, and wherein in the main signal path in each frequency band, noise in the input signal is reduced by use of the reduction parameter in that frequency band.

8 Claims, 5 Drawing Sheets

(51) Int. Cl.
*G10L 21/0216* (2013.01)
*G10L 21/0232* (2013.01)

(52) U.S. Cl.
CPC ..... *H04R 25/407* (2013.01); *G10L 21/0232* (2013.01); *G10L 2021/02166* (2013.01); *H04R 2225/43* (2013.01); *H04R 2430/03* (2013.01)

(56) References Cited

U.S. PATENT DOCUMENTS 5,027,410 A 6/1991 Williamson et al.
5,553,014 A * 9/1996 De Leon, II ..... H03H 21/0012 708/322
5,633,811 A * 5/1997 Canada ..... G01H 1/00 702/190
5,937,377 A * 8/1999 Hardiman ..... G10L 21/0208 704/225
6,240,192 B1 * 5/2001 Brennan ..... H04R 25/505 381/312
6,366,679 B1 * 4/2002 Steffen ..... H04H 20/88 381/26
6,580,798 B1 6/2003 Schaub
2010/0046776 A1 * 2/2010 Fischer ..... H04R 25/407 381/313
2010/0158158 A1 6/2010 Menu et al.
2016/0134969 A1 5/2016 Chen et al.

FOREIGN PATENT DOCUMENTS

CN 103856866 A 6/2014
DE 68926930 T2 1/1997
EP 0823829 A2 2/1998
EP 1519626 A2 3/2005
WO 2014085978 A1 6/2014

OTHER PUBLICATIONS

Diethorn et al.: "Subband Noise Reduction Methods for Speech Enhancement", Audio Signal Processing for Next-Generation Multimedia Communication Systems, Kluwer Academic Publishers, Jan. 1, 2004 (Jan. 1, 2004), Chapter 4, pp. 91-115, XP008167324, ISBN: 978-1-4020-7768-5.

* cited by examiner

METHOD AND HEARING AID FOR FREQUENCY-DEPENDENT REDUCTION OF NOISE IN AN INPUT SIGNAL

CROSS-REFERENCE TO RELATED APPLICATION

This application claims the priority, under 35 U.S.C. § 119, of German application DE 10 2015 204 253.7, filed Mar. 10, 2015; the prior application is herewith incorporated by reference in its entirety.

BACKGROUND OF THE INVENTION

Field of the Invention

The invention relates to a method and a hearing aid for frequency-dependent reduction of noise in an input signal, wherein the input signal is separated into a plurality of frequency bands each having a certain bandwidth and center frequency. Wherein in each frequency band, a reduction parameter is determined from the signal component of the input signal, and wherein in each frequency band, noise in the input signal is reduced by the reduction parameter for that frequency band.

In a hearing aid, in order to improve the hearing quality for a user, the need may arise, depending on the current hearing situation for the user, to perform noise reduction on an input signal that is captured by the microphone(s) of the hearing aid. Often, for example, a user is in a hearing situation in which the existence of wideband noise impedes the actually required perception of a wanted signal. In particular in this situation, the wanted signal may have a relatively narrowband frequency spectrum and originate from a spatially clearly definable sound source, whereas the noise cannot be associated with a clearly defined spatial direction owing to superposition of a multiplicity of sound sources having different frequency spectra and different relative positions with respect to the user.

The technical challenge in a hearing aid is then to lower the level of the noise in the input signal as far as possible, thereby reducing the noise, and at the same time this lowering is meant to have the minimum possible effect on the level of the wanted signal, i.e. the aim is to improve the signal-to-noise ratio, with only limited space being available in the hearing aid itself for installing the devices for the required signal processing.

In the hearing situation described, in which wideband noise is superimposed on a narrowband wanted signal and the noise is meant to be reduced, it is usual to apply frequency-band dependent amplification or reduction coefficients to the input signal. In this case, the input signal first passes through a filter bank, which separates the input signal into a plurality of frequency bands which each have a certain bandwidth and center frequency and which partially overlap. Then a reduction coefficient is determined for each individual frequency band from the level of the signal component in the frequency band, and the level of the input signal in the individual frequency bands is lowered or raised by the respective reduction coefficients. Hence in frequency bands in which there is no wanted signal but only noise, the signal level is reduced in proportion to the wanted signal. In frequency bands in which there is a high spectral component of the wanted signal, there is less of a drop in the level or the signal level is increased more strongly. The overall effect of this is to improve the signal-to-noise ratio.

As a result of the overlap of adjacent frequency bands, it can often happen, however, that a narrowband wanted signal whose main spectral components are primarily concentrated in one specific frequency band also results in an appreciable signal level in an adjacent frequency band owing to the overlap. This affects the reduction coefficient for lowering the signal level in the adjacent frequency band. The result is that less noise reduction takes place in the adjacent frequency band concerned owing to this effect on the reduction coefficient. Hence there is a poorer signal-to-noise ratio especially in the spectral region around the wanted signal.

SUMMARY OF THE INVENTION

The object of the invention is to define a method and a hearing aid for reducing noise in an input signal, in which method the noise reduction has the minimum possible effect on a narrowband wanted signal, and which method is intended to allow a best possible signal-to-noise ratio in particular in frequency bands close to the wanted signal.

The object is achieved according to the invention by a method for frequency-dependent reduction of noise in an input signal. The input signal is allocated to a main signal path and to an auxiliary signal path, and a filter bank separates the input signal into a plurality of frequency bands each having a certain bandwidth and center frequency. In the auxiliary signal path the bandwidth of the signal component is reduced in each frequency band, forming a reduced frequency band in each case, and in each reduced frequency band, a reduction parameter is determined from the signal component of the input signal. In the main signal path in each frequency band, noise in the input signal is reduced by of the reduction parameter in that frequency band. The dependent claims and the description below present advantageous embodiments of the invention, some of which are inventive in their own right.

In particular, the individual frequency bands each have an amplitude-frequency response having a passband which surrounds the center frequency and which on each side changes into a stopband as the distance from the center frequency increases, wherein no appreciable signal component is observable in the stopband of a frequency band. In particular here, the amplitude-frequency responses of a plurality of frequency bands also exhibit an appreciable overlap outside the respective stopbands, and in particular even the amplitude-frequency responses of frequency bands whose center frequencies are not immediately adjacent but are separated by other center frequencies also exhibit an appreciable overlap outside the respective stopbands.

In this case, the reduction parameters can be given in particular by reduction coefficients. The frequency-band based reduction of noise in the input signal by the respective reduction coefficients can be performed here, for example, by lowering the signal level in each frequency band in accordance with the reduction coefficient. Equally, the signal in each frequency band can be amplified according to the reduction coefficient, in other words the signal level can be raised. When reducing the bandwidth, the center frequency and the frequency response around the center frequency are preferably retained in each frequency band.

In particular, the input signal can initially be allocated to a main signal path and to an auxiliary signal path, and then separated into a plurality of frequency bands by a filter bank in each path. The frequency bands in the main signal path and in the auxiliary signal path have the same bandwidths and center frequencies in each path. In particular, the input signal can be duplicated for the purpose of allocating to a main signal path and an auxiliary signal path. Equally, however, the input signal can initially pass through a filter bank and then be allocated to a main signal path and an auxiliary signal path.

The invention is here based on the now described considerations. A fundamental problem with methods for frequency-dependent reduction of noise in an input signal is that for this purpose the input signal must preferably be filtered into individual frequency bands. The frequency bands should resolve the input signal without distortion as far as possible. Adjacent frequency bands here exhibit, at least at the edges of their respective passbands, a non-negligible overlap, which depends amongst other factors on the bandwidth of the respective frequency bands. If, for example, the input signal is resolved using a small number of broadband frequency bands, then the amplitude-frequency responses of the bands exhibit at the respective edges of the passbands a considerable overlap, i.e. at individual frequencies, the frequency responses of a plurality of frequency bands each have an appreciable amplitude.

Owing to this overlap of adjacent frequency bands, however, a narrowband wanted signal can also have a significant signal component in adjacent frequency bands and result in a corresponding level. This can affect here the reduction parameter in the adjacent frequency band, which impairs the noise reduction and hence the signal-to-noise ratio for this band. The frequency bands of a more narrowband filter, on the other hand, usually exhibit in each of their amplitude-frequency responses a steeper transition from the passband to the stopband in each case, whereby the overlap of adjacent frequency bands is also lower.

In order now to reduce the impairment in the reduction parameters of adjacent frequency bands, the individual frequency bands in the filtering cannot be designed to have an arbitrarily narrow bandwidth, however, because to reduce the bandwidth of a filter in the frequency domain requires a longer signal propagation delay of the input signal. This is undesirable, however, in particular in applications that must be implemented with as little delay as possible, for example in a hearing-aid device in which a captured, conditioned and reproduced acoustic signal should exhibit the minimum delay possible with respect to the visual impressions of a user. Thus as regards the operation of the filter bank, a trade-off between a required resolution of the filter bank and a still tolerable latency must be made for the noise-reduction method.

Hence since the bandwidth of the individual frequency bands of the filter bank cannot be reduced arbitrarily, there is also a lower limit to the overlap between adjacent frequency bands. Improving the noise reduction in the spectral region around a narrowband wanted signal is thus not possible to achieve in the present case by reducing the bandwidth of the individual frequency bands of the filter bank.

The individual frequency bands are combined to form the full spectrum in such a way that the respective signal components of the frequency bands reproduce an input signal in the output signal. Re-filtering the signal components in the individual frequency bands can thus result in distortion in the final signal, because this re-filtering could arbitrarily distort and/or attenuate spectral components of the input signal. Thus a reduction in the influence that a narrowband wanted signal exerts on the noise reduction in adjacent frequency bands can also not be performed by direct filtering of the signal components in the frequency bands that form the output signal.

A surprising finding, which is essential to the invention, is not to filter, i.e. reduce the bandwidth of, those signal components of the frequency bands that form the output signal, but to reduce the bandwidth in the individual frequency bands only for calculating the reduction coefficients that are used to perform the frequency-band dependent noise-reduction. The reduction parameters calculated in this way can then be used in each frequency band to reduce noise in the input signal, whereby the spectral information in the signal components in each of the individual frequency bands is retained for the output signal.

This procedure has the following advantages: reducing the bandwidth and/or the passband in a frequency band before calculating the reduction parameter in that band reduces the overlap and/or crosstalk of adjacent frequency bands. This means that the signal component of the input signal that is used to determine the reduction parameters is registered primarily only in the desired frequency band. If the noise in the input signal is now reduced in the main signal path in each frequency band by the reduction coefficients determined in this way, then a narrowband wanted signal has a far smaller effect on the reduction parameters in adjacent frequency bands, thereby improving the signal-to-noise ratio. The fact that additional filtering, i.e. bandwidth reduction, in the individual frequency bands is performed only for calculating the reduction parameters but not for the output of the final signal, means that the spectral information in the signal component in each frequency band is retained, whereby distortion in the output signal can be prevented.

Advantageously, in each of a number of reduced frequency bands, a level of the signal component over the reduced bandwidth is used to determine the reduction coefficient. In particular if the wanted signal contains a plurality of narrowband signal peaks that occur in one reduced frequency band or in a few reduced frequency bands, a reduction coefficient that is determined using the integrated level can reproduce faithfully the real spectral characteristics of the wanted signal, in particular the spectral density, in the reduced frequency band.

It proves advantageous if the input signal is digitized at least for the auxiliary signal path. In this case, the input signal can also be digitized for the main signal path. Both reducing the bandwidth and determining the reduction coefficients can be performed particularly efficiently in a digitized input signal, because apart from an A/D converter in the signal path and a D/A converter that may be required for potential reconversion of the noise-reduced output signal, no further hardware is needed for this purpose. This allows the method to be used even in devices in which space for installing hardware is severely limited, as is the case in a hearing aid for example.

Advantageously, in the auxiliary signal path, a filter is used to reduce the bandwidth of the signal component in each frequency band. Using a filter allows the bandwidth to be reduced particularly efficiently in terms of time.

It also proves advantageous here if in the auxiliary signal path, the center frequency is shifted to zero for each frequency band, and then the bandwidth of the signal component is reduced by a low-pass filter. By shifting the center frequency to zero, it is possible to reduce the bandwidth in all the frequency bands in the same way, which simplifies implementation of the bandwidth reduction. If in the auxiliary signal path the intention is solely to determine the respective reduction coefficients from the reduced frequency bands, then readjusting the center frequency to its original value can be omitted. In general, the filter bank can also be formed by a plurality of bandpass filters, wherein each of the bandpass filters can be implemented by a low-pass filter multiplied by a phase that depends on the particular channel of the filter bank. The bandwidth reduction can here be performed by using a further low-pass filter.

In another advantageous embodiment of the invention, the input signal is captured by a directional microphone, wherein by the reduction parameters, the noise in the input signal is reduced by frequency-dependent adaption of the directivity of the directional microphone. Especially for directional microphones, frequency-dependent noise reduction that is also dependent on the spatial direction from which a sound arrives may be required. In this case, the defined method allows efficient noise reduction that maintains the preferred directivity of the directional microphone as much as possible. The reduction parameters can here be used in particular for determining the directional parameters, i.e. directivities, in the individual frequency bands.

In this case, the directional microphone advantageously registers a multichannel input signal, wherein a filter bank separates the input signal in each channel into a plurality of frequency bands. For each channel, a reduction parameter for each frequency band is determined by the corresponding reduced frequency band, and for each frequency band, the directivity is adapted from the signal components of all the channels according to the respective reduction parameters. In particular, a differential directional microphone can be used here.

A differential directional microphone contains two or more usually omnidirectional microphones, the signals from which are superimposed, each with a minimal time delay, in such a way that this time delay can offset the actual time delay with which a sound coming from a specific spatial direction arrives at, and is registered by, the individual microphones. The sound from the corresponding spatial direction can thereby be reduced in the output signal from the directional microphone. The spatial dependency of the reduction, i.e. of the sensitivity, is referred to here as the directivity. This can also vary according to frequency.

Now if the sound from a specific spatial direction is meant to be reduced by the directivity regardless of frequency, a narrowband sound signal from a different spatial direction can cause, in frequency bands in a region around the sound signal, the directivity to be adapted to the sound signal, thereby modifying the desired reduction. The defined method can be used to lessen in other frequency bands the effect of a narrowband sound signal of this type from a spatial direction that is different from the direction in which reduction is required.

The invention also defines a hearing aid, in particular a hearing-aid device, containing at least one microphone for capturing an input signal, and a signal processing unit, which is designed to perform the above-described method. The advantages mentioned for the method and its development can be applied analogously to the hearing aid.

Other features which are considered as characteristic for the invention are set forth in the appended claims.

Although the invention is illustrated and described herein as embodied in a method and a hearing aid for frequency-dependent reduction of noise in an input signal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Corresponding parts and variables are denoted by the same reference signs in each of the figures.

Figure 1:
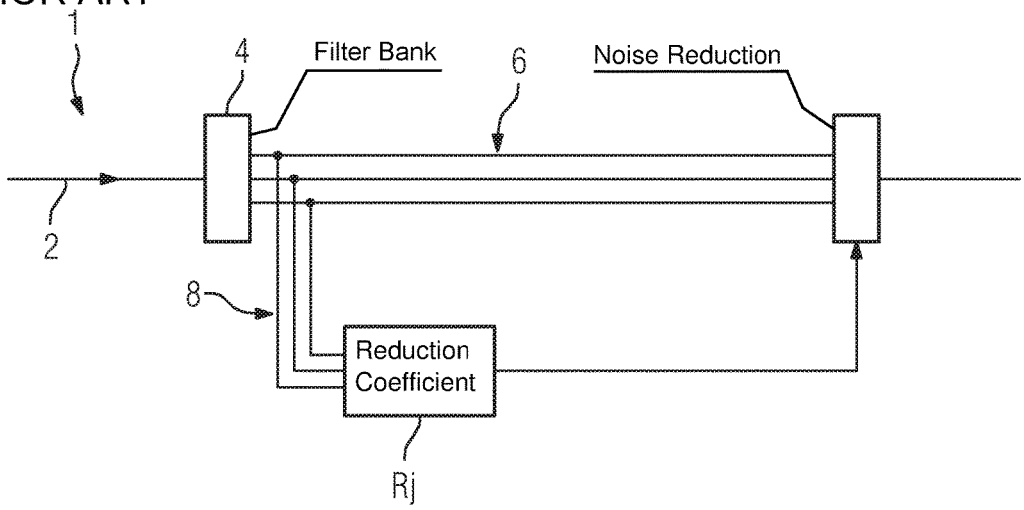
FIG 1 PRIOR ART
FIG. 1 is a block diagram of a method for frequency-dependent reduction of noise in an input signal according to the prior art.

Referring now to the figures of the drawings in detail and first, particularly to FIG. 1 thereof, there is shown a block diagram of a method 1 for frequency-dependent reduction of noise according to the prior art. A filter bank 4 separates an input signal 2 into different frequency bands, which are not shown in greater detail here. Then the input signal 2 is allocated to a main signal path 6 and to an auxiliary signal path 8. In the auxiliary signal path 8, a reduction parameter in the form of a reduction coefficient Rj is determined for each of the individual frequency bands from the level of the signal component in the frequency band. In the main signal path 6, the signal level in each frequency band is lowered or raised by the reduction coefficient Rj, whereby noise in the input signal 2 is reduced in a frequency-dependent manner.

Figure 2:
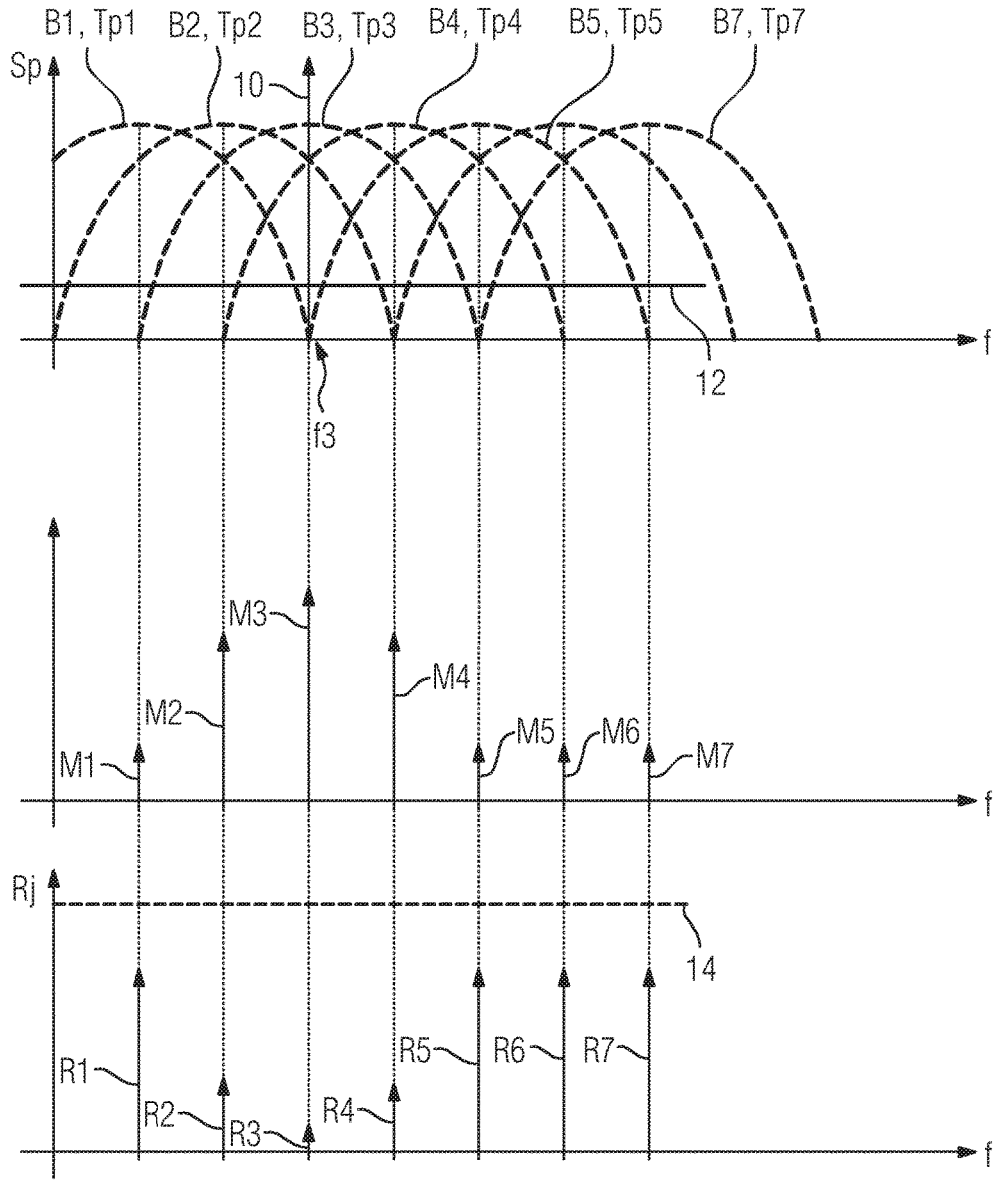
FIG 2 PRIOR ART
FIG. 2 is a graph showing in the frequency domain a determination of the reduction coefficients for the method shown in FIG. 1.

FIG. 2 shows in the frequency domain the principle of operation of the method 1 described with reference to FIG. 1. The input signal 2, which is plotted as a function of the frequency f, is here formed by an extremely narrowband wanted signal 10 and wideband background noise 12. The signal level Sp for the wanted signal 10 is in this case considerably higher than for the noise 12. The amplitude-frequency responses Tp1 to Tp7 for the frequency bands B1 to B7 respectively are used here to illustrate the principle of operation of the filter bank 4. The wanted signal 10 lies precisely at the center frequency f3 of the frequency band B3 but is still contained in the adjacent frequency bands B2 and B4. In order to determine the reduction coefficients R1 to R7, then for each individual band of the frequency bands B1 to B7 is determined the signal level M1 to M7 that appears within the amplitude-frequency response Tp1 to Tp7 of the corresponding frequency band. The reduction coefficient R1 to R7 is now determined from the levels M1 to M7 in the respective frequency bands by subtracting the level M1 to M7 from an initial value 14 for the reduction.

Figure 3:
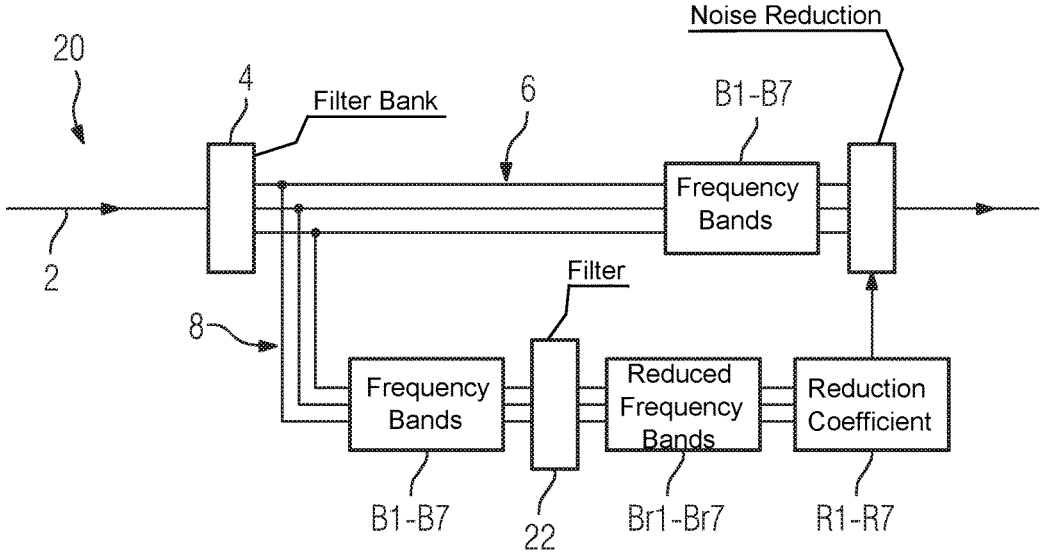
FIG. 3 is a block diagram of a method for frequency-dependent reduction of noise in an input signal.

FIG. 3 shows a block diagram of the procedure of a method 20 for frequency-dependent reduction of noise in an input signal 2. The input signal 2 is separated into a plurality of frequency bands B1 to B7 by a filter bank 4 and is then allocated to a main signal path 6 and an auxiliary signal path 8. In the auxiliary signal path 8, the individual frequency bands B1 to B7 are each reduced in bandwidth by a filter 22, thereby forming in each case a reduced frequency band Br1 to Br7. In the auxiliary signal path 8, the signal component of the input signal 2 in each reduced frequency band Br1 to Br7 is used to determine a reduction parameter in the form of a reduction coefficient R1 to R7, and in the main signal path 6, the signal level in each frequency band B1 to B7 is lowered or raised by the respective reduction coefficients R1 to R7 that were determined in the auxiliary signal path 8, in order thereby to reduce noise in the input signal 2 in a frequency-dependent manner.

Figure 4:
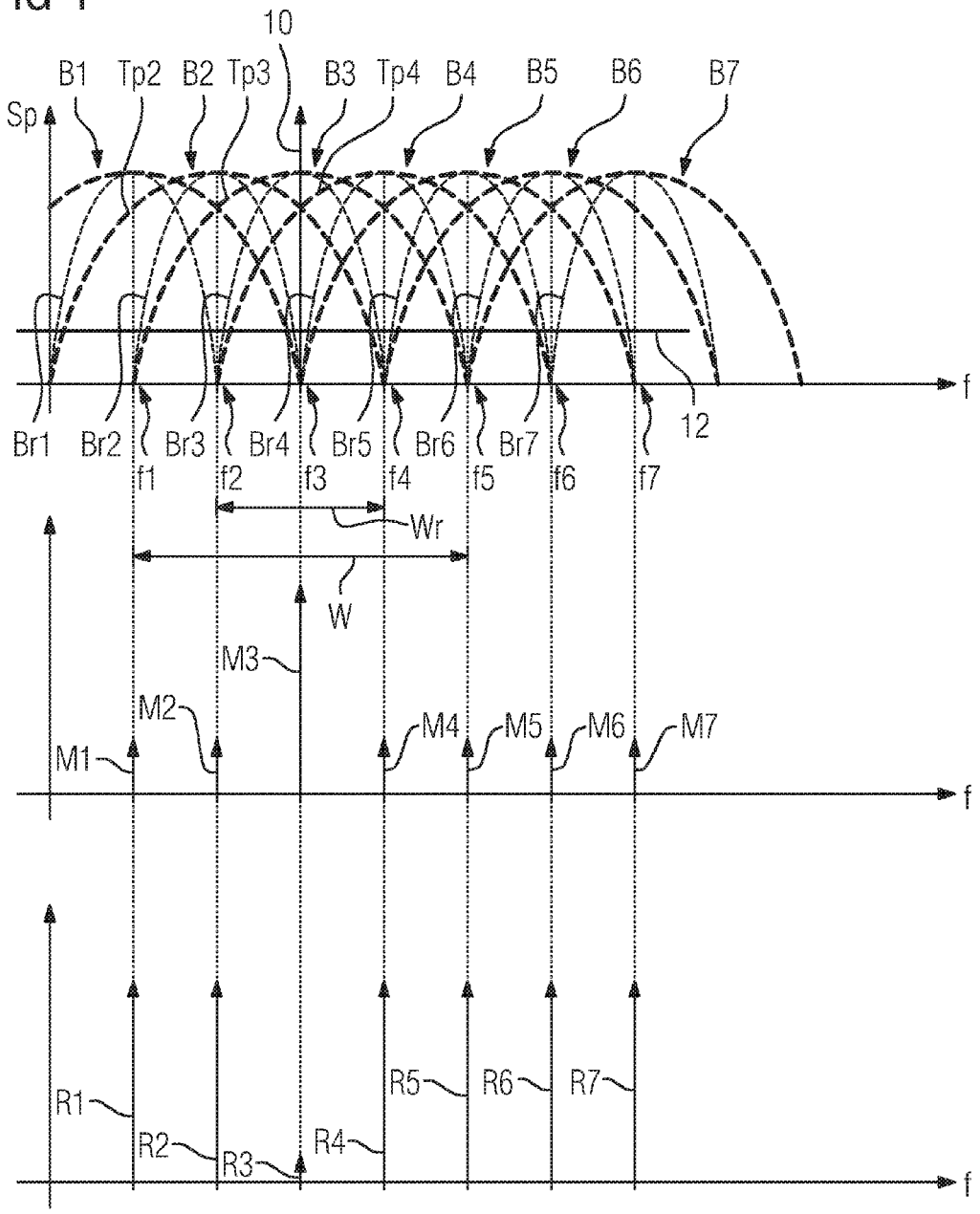
FIG. 4 is a graph showing in the frequency domain the determination of the reduction coefficients for the method shown in FIG. 3.

FIG. 4 illustrates the principle of operation of the method 20 shown in FIG. 3. The signal level Sp of the input signal 2, which is formed by a narrowband wanted signal 10 superimposed by wideband noise 12, is plotted here against frequency f. The filter bank 4 separates the input signal 2 into individual frequency bands B1 to B7 each of different center frequency f1 to f7 and identical bandwidth W. In this case, the wanted signal 10 is initially included in the frequency bands B2 to B4, but because of the different amplitude-frequency responses Tp2 to Tp4 at the frequency of the wanted signal 10 it has a different signal level Sp for the individual frequency bands B2 to B4. The filter 22 now performs in the auxiliary signal path 8 a further reduction in the bandwidth W in each frequency band B1 to B7. The bandwidth is reduced here to Wr for each frequency band, thereby forming in each case a reduced frequency band Br1 to Br7 each having the same center frequency f1 to f7 as the original frequency band B1 to B7.

As a result of this reduction in the bandwidth W of the frequency bands B1 to B7, the wanted signal 10 is now only observable at an appreciable signal level Sp in a reduced frequency band Br3. If now the signal level M1 to M7 is determined in each reduced frequency band Br1 to Br7, then outside the reduced frequency band Br3, this level is determined by the noise 12. In particular, the level M2, M4 in the reduced frequency bands Br2, Br4, which lie immediately adjacent to the reduced frequency band Br3, which registers the main spectral component of the wanted signal 10, is not affected by the wanted signal 10. The reduction coefficients R1 to R7 formed from the levels M1 to M7 and which are intended to be used for lowering the level of the input signal 2 in the main signal path 6 for the corresponding frequency band B1 to B7, exhibit only for the reduction parameter R3 a significant deviation from an otherwise constant noise reduction characteristic.

The frequency band B3, which registers the wanted signal 10, is thus largely omitted from the noise reduction by virtue of the lower reduction coefficient R3. The adjacent frequency bands B2, B4, however, experience the full noise reduction. The signal component of the wanted signal 10 in the amplitude-frequency responses Tp2, Tp4 thus no longer results in a decrease in the reduction coefficients R2, R4, which would lead to insufficient noise suppression in the region around the wanted signal 10. The signal-to-noise ratio is thus improved in particular in the region around the wanted signal 10.

Figure 5:
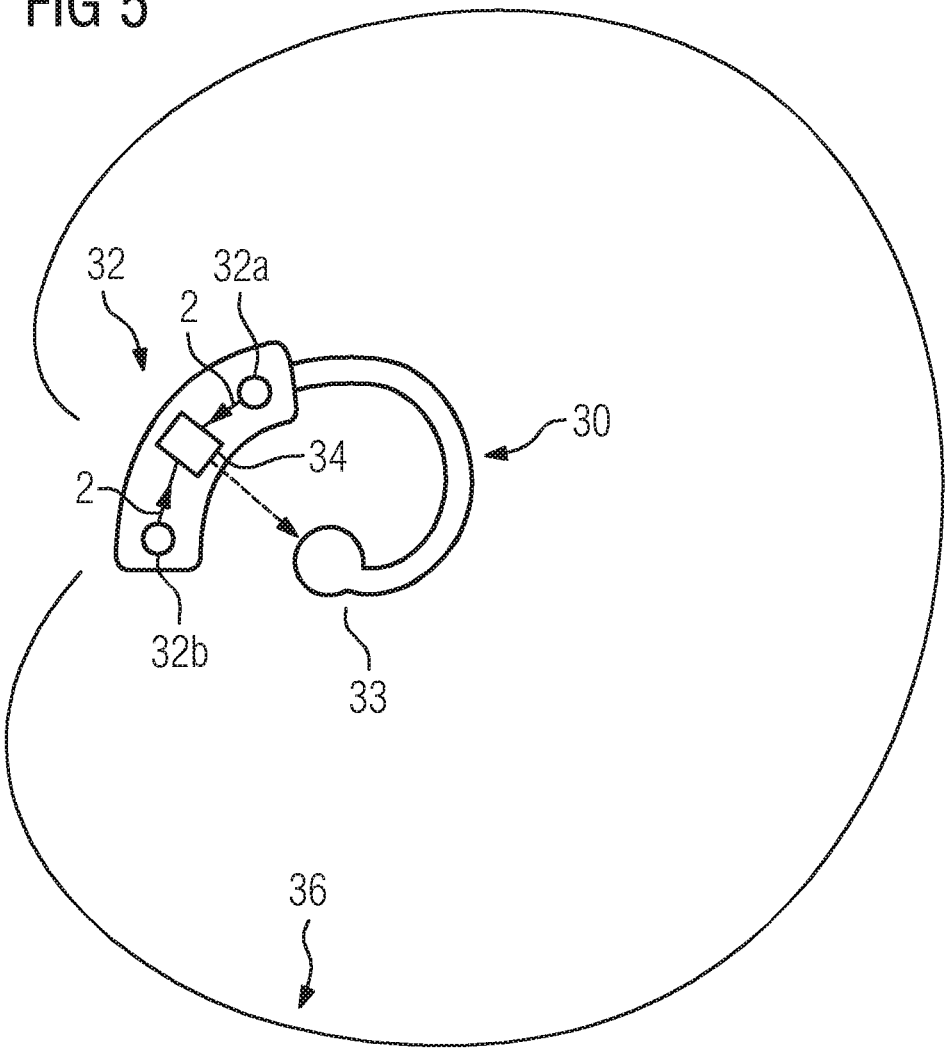
FIG. 5 is an illustration showing a hearing-aid device containing a signal processing unit.

FIG. 5 shows schematically a hearing aid 30 in the form of a hearing-aid device, which contains a directional microphone 32, an earpiece 33 and a signal processing unit 34. The directional microphone 32 here contains two omnidirectional microphones 32*a*, 32*b*, which send a dual-channel input signal 2 to the signal processing unit 34. The signal processing unit 34 is configured to form a directivity 36 for each of a plurality of frequency bands, and for each frequency band to adapt the directivity according to reduction parameters determined in the above-described manner in order thereby to provide directional reduction in noise. The noise-reduced output signal, if applicable after further signal processing, is transmitted from the signal processing unit 34 to the earpiece 33.

Although the invention has been illustrated and described in greater detail using the preferred exemplary embodiment, the invention is not limited by this exemplary embodiment. A person skilled in the art can derive other variations therefrom without departing from the scope of protection of the invention.

The invention claimed is:

1. A method for frequency-dependent reduction of noise in an input signal, which comprises the steps of:

separating the input signal into a plurality of frequency bands each having a bandwidth and center frequency via a filter bank;

directing the plurality of frequency bands to a main signal path and to an auxiliary signal path;

wherein in the auxiliary signal path, reducing the bandwidth of a signal component in each of the frequency bands forming a reduced frequency band in each case;

determining in the reduced frequency band, a reduction parameter from the signal component of the input signal; and wherein in the main signal path, reducing the noise in the input signal in each of the frequency bands by means of the reduction parameter for a respective frequency band of the frequency bands.

2. The method according to claim 1, wherein in each of a number of the reduced frequency bands a level of the signal component over a reduced bandwidth is used to determine the reduction parameter.

3. The method according to claim 1, which further comprises digitizing the input signal at least for the auxiliary signal path.

4. The method according to claim 1, wherein in the auxiliary signal path, using a further filter to reduce the bandwidth of the signal component in each of the frequency bands.

5. The method according to claim 4, wherein in the auxiliary signal path, shifting the center frequency to zero for each of the frequency bands, and then the bandwidth of the signal component is reduced by the further filter being a low-pass filter.

6. The method according to claim 1, which further comprises:

capturing the input signal via a directional microphone; and reducing, by means of reduction parameters, the noise in the input signal by frequency-dependent adaption of a directivity of the directional microphone.

7. The method according to claim 6, wherein:

the directional microphone registers a multichannel input signal;

the filter bank separates the input signal in each of the channels into the plurality of frequency bands;

for each of the channels, determining the reduction parameter for each of the frequency bands by means of the reduced frequency band; and for each of the frequency bands, adapting the directivity from signal components of all the channels according to the reduction parameters.

8. A hearing aid, comprising:

at least one microphone for capturing an input signal; and a signal processing unit configured to perform a method according to claim 1.

* * * * *